US005603379A

United States Patent [19]

Henke et al.

[11] Patent Number: 5,603,379

[45] Date of Patent: Feb. 18, 1997

[54] BI-DIRECTIONAL EXPLOSIVE TRANSFER APPARATUS AND METHOD

[75] Inventors: Joseph A. Henke, Lewisville; Flint R. George, Flower Mound, both of Tex.

[73] Assignee: Halliburton Company, Dallas, Tex.

[21] Appl. No.: 589,835

[22] Filed: Jan. 22, 1996

Related U.S. Application Data

[63] Continuation of Ser. No. 299,708, Aug. 31, 1994, abandoned.

[51] Int. Cl.[6] ..... E21B 43/1185

[52] U.S. Cl. ..... 166/297; 166/55.1; 175/4.51

[58] Field of Search ..... 166/55.1, 297; 175/4.51, 4.54, 4.55, 4.56; 102/275.3, 275.4, 275.5, 275.6, 275.7, 275.8

[56] References Cited

U.S. PATENT DOCUMENTS

| | | | |
|---|---|---|---|
| 1,908,844 | 5/1933 | Holtson | 285/276 |
| 1,961,583 | 6/1934 | Hamer | 285/276 X |
| 2,532,669 | 12/1950 | Jones | 285/278 X |
| 2,681,110 | 6/1954 | Harrison | 175/4 |
| 3,211,093 | 10/1965 | McCullough et al. | 175/4.6 |
| 3,291,207 | 12/1966 | Rike | 166/254.2 |
| 4,194,577 | 3/1980 | Vann | 175/4.51 |
| 4,491,185 | 1/1985 | McClure | 175/4.56 |
| 4,523,649 | 6/1985 | Stout | 175/4.51 |
| 4,616,566 | 10/1986 | Yates, Jr. | 102/318 |
| 4,650,009 | 3/1987 | McClure et al. | 175/4.56 X |
| 5,033,553 | 7/1991 | Miszewski et al. | 175/4.51 |
| 5,107,927 | 4/1992 | Whiteley et al. | 166/55.1 |

FOREIGN PATENT DOCUMENTS

| | | | |
|---|---|---|---|
| 258201 | 10/1970 | U.S.S.R. | 175/4.55 |

OTHER PUBLICATIONS

Schlumberger Tubing–Conveyed Perforating 1988 Catalog Pages 4–20 and 4–21. Hydraulic Eccentering Swivel and Universal Gun Swivel. Aug. 1988.

Vann Systems, Engineered Well Completion Product Catalog, Jan. 1989, pp. A3–A7, TCP–1013 and E–13.

*Primary Examiner*—Hoang C. Dang

*Attorney, Agent, or Firm*—William M. Imwalle; Neal R. Kennedy

[57] ABSTRACT

A bi-directional explosive transfer apparatus for use in connecting and orienting perforating guns in a well. The apparatus includes a connector having first and second housing portions which are pivotally attached to one another. First and second explosive devices in the connector provide a bi-directional explosive path between perforating guns joined by the connector. At least one orienting fin is attached to the perforating guns to position the guns off-center so that they will orient themselves by gravity in a deviated well section. The swivel connection provided by the connector allows the guns to rotate individually as necessary and relative to the other guns. A method of perforating a well using the apparatus is also disclosed.

24 Claims, 2 Drawing Sheets

BI-DIRECTIONAL EXPLOSIVE TRANSFER APPARATUS AND METHOD

This is a continuation of application Ser. No. 08/299,709, filed on Aug. 31, 1994, now abandoned.

BACKGROUND OF THE INVENTION

1. Field of the Invention

This invention relates to apparatus for perforating a well formation, and more particularly, to an apparatus and method for firing a series of perforating guns from different directions and also to an apparatus and method for orienting perforating guns in a deviated well.

2. Description of the Prior Art

The completion of oil and gas wells by gun perforating is well known in the art. A string of perforating guns is lowered into a well casing cemented into the wellbore, and the perforating gun is positioned adjacent to the formation desired to be perforated. The perforating guns are fired to penetrate the casing and cement and form perforations in the producing formation for recovery of the desired fluids. These perforating guns typically utilize shaped charges to form the perforations.

Typically, a firing head is positioned at the top of the string of guns and is connected to the uppermost gun of a string of guns. A time domain firer (TDF) is positioned between adjacent pairs of guns. When the firing head is triggered, the uppermost gun is then fired, and the time domain firers then cause the string of guns to be fired sequentially from top to bottom. On occasion, the firing sequence is from bottom to top.

In the event of misfiring of guns, it may be necessary to remove the string from the wellbore, and this is a time-consuming and expensive procedure. Therefore, there exists a need for a string of guns which may be fired from one end, but in the event of misfire, may also be fired from the other end with the desired result that all of the guns are fired. In order to do this, it is necessary to have a connection between the guns which will work bi-directionally. The present invention addresses this need by providing a bi-directional explosive transfer apparatus for use between a pair of guns.

Special problems must be addressed in situations involving the completion of highly deviated or horizontal wells. In such cases, it may be difficult or impossible to orient the guns so that they fire in a specific direction. Therefore, guns must be used which fire in substantially all directions, which may not result in the most desirable flow of fluids. The present invention meets this need by providing a string of perforating guns in which the guns are easily oriented in a predetermined position for more directional firing.

SUMMARY OF THE INVENTION

The present invention includes an apparatus, for use in connecting downhole perforating guns, which provides a bi-directional explosive path between the guns and allows relative rotation of the guns for self-orientation thereof in the wellbore.

The apparatus comprises a housing adapted for attachment to the perforating guns wherein the housing defines a housing cavity therein, a first explosive device disposed in the housing cavity, and a second explosive device disposed in the cavity. The first explosive device provides an explosive transfer from one of the guns to the second explosive device, and the second explosive device provides an explosive transfer from another of the guns to the first explosive device. Stated in another way, one of the first and second explosive devices provides an explosive transfer from a corresponding one of the guns to the other of the first and second explosive devices.

In the preferred embodiment, the housing comprises first and second housing sections, and the housing cavity comprises a first housing cavity portion defined in the first housing section and a second cavity portion defined in the second housing section.

The first and second housing sections are preferably pivotally connected. In one embodiment, the first and second housing sections define a bearing raceway therebetween, and the apparatus further comprises a bearing means adjacent to the raceway for providing relative rotation between the housing sections. This bearing means may be characterized by a plurality of balls disposed in the raceway and in rolling contact therewith.

Stated in another way, the apparatus comprises a housing comprising first and second housing portions pivotally attached to one another, each housing portion being adapted for attachment to a perforating gun, and explosive means disposed in the first and second housing portions for providing an explosive path through the housing. The explosive path is preferably bi-directional.

The invention may also be described as a well perforating apparatus comprising a first perforating gun, a swivel connection attached to the first perforating gun, and a second perforating gun attached to the swivel connection such that relative rotation is provided between the first and second perforating guns. The apparatus further comprises an explosive means for providing an explosive path from one of the first and second perforating guns to the other of the first and second perforating guns.

The well perforating apparatus further comprises an orienting fin disposed on at least one of the perforating guns. The fin is adapted for substantially orienting one of the perforating guns in a predetermined position with respect to the wellbore. Preferably, at least two of such fins are used and angularly disposed from one another. At least one of the fins may be said to be generally opposite a firing head of one of the perforating guns.

The invention further includes a method of perforating a well comprising the steps of positioning a string of perforating guns in a wellbore wherein the string comprises at least an upper and a lower perforating gun, providing rotation of the guns with respect to one another and thereby placing the guns in a desired orientation with respect to the wellbore, and firing one of the upper and lower guns and thereby sequentially firing a remainder of the guns. The method may further comprise, prior to the step of positioning, the step of placing a bi-directional explosive device between the adjacent guns. The step of providing rotation preferably comprises positioning a swivel connection between the guns so that the guns are free to rotate and orient themselves by gravity.

Numerous objects and advantages of the invention will become apparent as the following detailed description of the preferred embodiment of the invention is read in conjunction with the drawings which illustrate such embodiment.

DESCRIPTION OF THE PREFERRED EMBODIMENT

Figure 1:
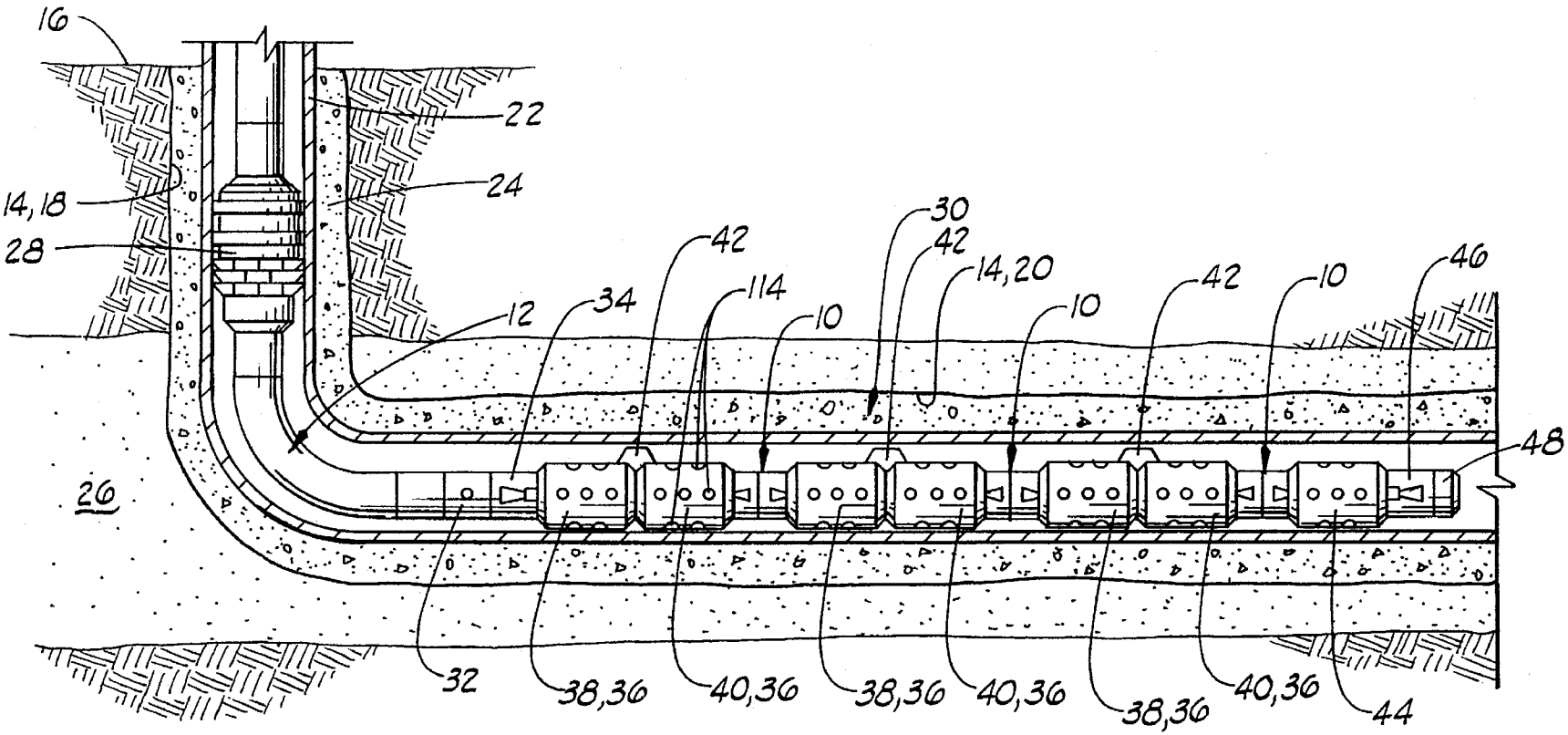
FIG. 1 shows a schematic section view of a well having a deviated portion cased and cemented with a perforating gun string positioned therein and incorporating the bi-directional explosive transfer apparatus of the present invention.

Referring now to the drawings, and more particularly to FIG. 1, the bi-directional explosive transfer apparatus of the present invention is shown and generally designated by the numeral 10. Several of apparatus 10 may be used in a tubing string 12 adapted for positioning in a wellbore 14 extending downwardly from the earth's surface 16. Wellbore 14 is illustrated as having an initial, generally vertical portion 18 and a lower, generally deviated portion 20. In FIG. 1, deviated portion 20 is shown as a horizontal portion 20. The invention may be applicable to other well configurations, including non-deviated wells.

A casing string 22 is located within wellbore 14 and is held therein by cement 24.

Horizontal portion 20 of wellbore 14 is shown as intersecting a subterranean formation 26, of which a portion thereof is to be perforated.

Tubing string 12 is positioned in wellbore 14 in a conventional manner. Items known in the art, such as a wellhead at earth surface 16 are omitted for simplicity.

Tubing string 12 comprises a retrievable packer 28 which may be sealingly engaged with casing 22 in vertical portion 18 of wellbore 14. At the lower end of tubing string 12 is a gun string, generally designated by the numeral 30.

In the illustrated embodiment, gun string 30 comprises at its upper end a ported nipple 32 below which is a time domain firer (TDF). Time domain firer 34 is disposed at the upper end of a tandem gun set 36 comprising first and second guns 38 and 40. A plurality of such gun sets 36 are utilized, and each gun set 36 has at least one orienting fin 42 extending therefrom to insure that the gun set is disposed off-center with regard to casing 22. As will be further described herein, preferably there are two such fins 42 for each gun set 36. While a tandem gun set 36 has been described, it should be understood that any arrangement of guns might be utilized with orienting fins 42.

Between each gun set 36 is bi-directional explosive transfer apparatus 10. Apparatus 10 may thus be referred to as a connector 10 for connecting gun sets 36 together. As will be further described herein, bi-directional explosive transfer apparatus 10 comprises a swivel means for allowing individual and relative rotation of tandem gun sets 36.

Below the lowermost apparatus 10 is a lower gun 44. While an individual lower gun 44 has been illustrated, another tandem gun set 36 could also be positioned at this location. Another time domain firer 46 is attached to the bottom of lower gun 44, and a bottom closure 48 is attached to the lower end of TDF 46.

Figure 4:
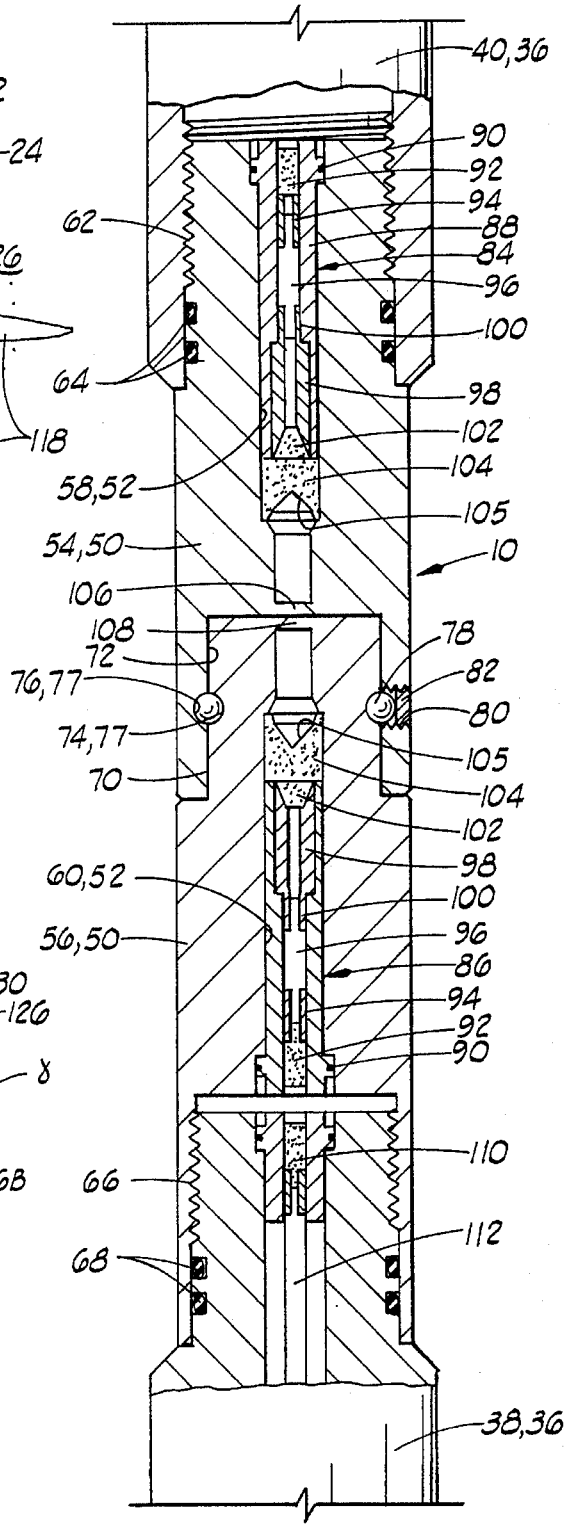
FIG. 4 shows a longitudinal cross section of the bi-directional explosive transfer apparatus of the present invention.

Referring now to FIG. 4, apparatus 10 comprises a housing 50 defining a housing cavity 52 therein. Housing 50 itself includes a first or upper housing portion or section 54 and a second or lower housing portion or section 56. Upper housing portion 54 defines a first or upper housing cavity portion 58 which is a part of housing cavity 52, and lower housing portion 56 defines a first or lower housing cavity portion 60 which is also a part of housing cavity 52.

Upper housing portion 54 is attached to a second gun 40 of one of gun sets 36 at threaded connection 62. A sealing means, such as a plurality of O-rings 64, provides sealing engagement between upper housing 54 and the corresponding second gun 40.

Second housing portion 56 is attached to first gun 38 of another gun set 36 at threaded connection 66. A sealing means, such as a plurality of O-rings 68, provides sealing engagement between lower housing portion 56 and the corresponding first gun 38.

Lower housing portion 56 has a reduced diameter portion 70 which fits within a bore 72 in upper housing portion 54.

An outwardly facing annular groove 74 is defined in reduced diameter portion 70 of lower housing portion 56. Groove 74 has a substantially semicircular cross section. An inwardly facing annular groove 76 is defined in bore 72 of upper housing portion 54 and is aligned with groove 74. Groove 76 also has a substantially semi-circular cross section so that aligned grooves 74 and 76 form an annular channel 77 of substantially circular cross section.

A plurality of ball bearings 78 are disposed in channel 77 between grooves 74 and 76, and the ball bearings are in rolling contact with the grooves. Ball bearings 78 are inserted into channel 77 through an opening 80 in upper housing portion 54. Opening 80 is later closed by a threaded plug 82. It will thus be seen by those skilled in the art that upper housing portion 54 and lower housing portion 56 are thus rotatably connected together by a swivel means formed by ball bearings 78 and grooves 74 and 76. Groove 74 may be considered an inner race 74 for ball bearing 78, and groove 76 may be considered an outer race 76 for the ball bearings. Thus, channel 77 may be referred to as a raceway 77.

A first explosive device 84 is disposed in upper housing cavity 58, and is adapted to provide an explosive transfer between second gun 40 and lower housing portion 56. Similarly, a second explosive device 86 is disposed in lower housing cavity 60 and is adapted for providing an explosive transfer between first gun 38 and upper housing portion 54. Second explosive device 86 is substantially identical to first explosive device 84 but is positioned in an opposite direction. As will be further described, first and second explosive devices provide a bi-directional explosive path longitudinally through housing 50.

First explosive device 84 comprises an insert 88 which is held in upper housing cavity 58 by a retaining means, such as the frictional engagement of an O-ring 90. A booster 92 is disposed in the upper end of insert 88. Booster 92 has a metallic portion 94 which is crimped around one end of a length of detonation cord 96, also referred to as DET cord 96. A detonation cord initiator 98, also referred to as a DET cord initiator 98, has a metallic portion 100 which is crimped around the other end of DET cord 96. DET cord initiator 98 also includes a powder charge 102. A shaped charge 104 having a conical cavity 105 therein is positioned adjacent to charge 102.

As shown in FIG. 4, second explosive device 86 is made of substantially identical components as is first explosive device 84.

Upper housing portion 54 has a wall portion 106 which closes the lower end of upper housing cavity 58. Similarly, lower housing portion 56 has a wall portion 108 which closes the upper end of lower housing cavity 60. Thus, wall portions 106 and 108 are adjacent to one another. It will be seen that wall portions 106 and 108 separate upper and lower housing cavities 58 and 60 of housing cavity 52. In the preferred embodiment, but not by way of limitation, upper and lower housing portions 54 and 56 are made of steel, and thus, wall portions 106 and 108 provide a steel barrier between first and second explosive devices 84 and 86.

In FIG. 4, first gun 38 has a firing device 110 which is connected to the firing heads themselves (not shown) by a length of detonation cord 112. This example of first gun 38 is merely for illustrative purposes. Virtually any type of known perforating gun may be used with bi-directional firing transfer apparatus 10.

OPERATION OF THE INVENTION

Tubing string 12 with gun string 30 forming a lower end thereof is positioned in casing 24 of wellbore 14 in a manner known in the art. Tubing string 12 is positioned so that gun string 30 is located as desired with respect to formation 26. Packer 28, if used, is set in a known manner.

Figure 2:
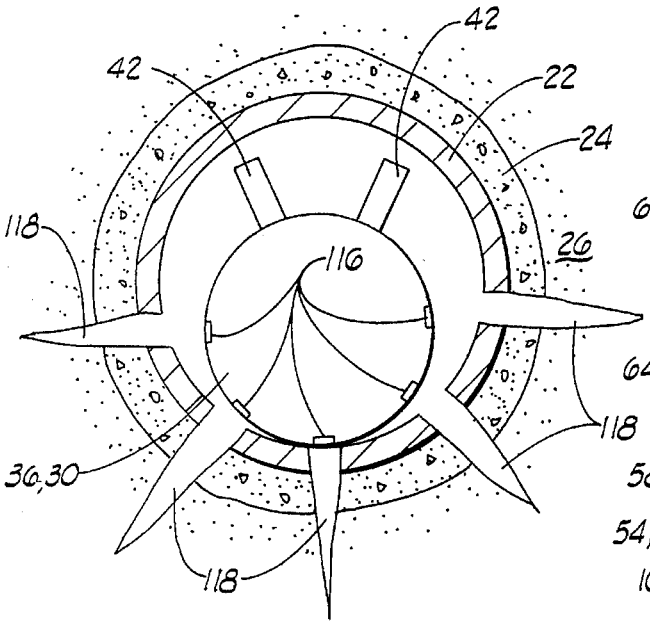
FIG. 2 shows a vertical cross section through the deviated portion of the well, illustrating the orientation of the guns and showing an example of directional perforations after the guns are fired.

As illustrated in FIG. 1, first and second guns 38 and 40 of gun set 36 and lower gun 44 have a plurality of perforating charges 114 which are equally angularly disposed around a longitudinal axis of the guns. In this way, a plurality of substantially evenly distributed perforations may be made through casing 22 in cement 24 into formation 26. However, on many occasions, it is desirable to have the perforations be more specifically directed. For example, but not by way of limitation, it may be desirable to have perforations 118 directed mostly downwardly and located in the lower half of casing 22, as seen in FIG. 2. Orienting fins 42 in conjunction with the swivel connection provided by ball bearings 78 in bi-directional explosive transfer apparatus 10 help orient gun sets 36 so that they are substantially located as illustrated in FIG. 2. Thus, in FIG. 2, mostly downwardly directed perforating charges 116 are illustrated which are used to form perforations 118.

As shown in FIG. 2, orienting fins 42 will keep gun string 30 located off-center with respect to casing 22. When gun string 30 enters deviated portion 20 of wellbore 14, in this case shown as substantially horizontal, gun sets 36 will tend to individually move by gravity toward the lower side of casing 22 so that orienting fins 42 extend generally upwardly. Gun sets 36 may thus be said to be self-orienting. FIG. 2 illustrates the nominal position in which orienting fins 42 extend at the same angle with respect to a horizontal or vertical axis through casing 22.

Figure 3:
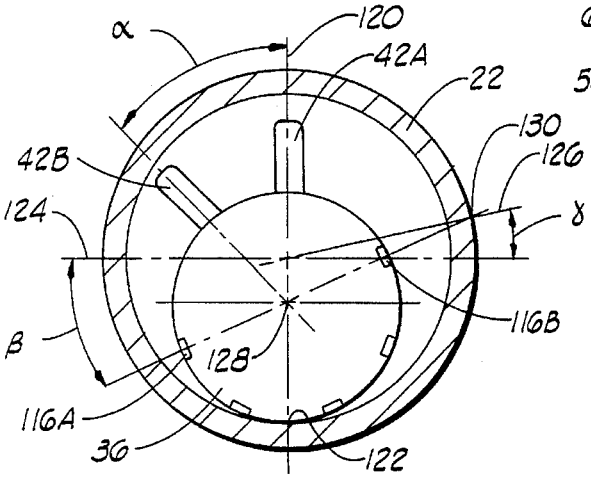
FIG. 3 is a cross-sectional, schematic illustrating the potential deviation from a nominal orientation of the guns in the deviated portion of a well.

There has to be sufficient spacing between the maximum distance from the outer tip of orienting fins 42 to the opposite other side of gun sets 36 so that tubing string 12 will not hang up in casing 22 as it is positioned. Thus, there may be some misalignment of gun sets 36 since they may not perfectly position themselves as a result of the fact that the outer tips of orienting fins 42 will not necessarily contact the inner surface of casing 22. FIG. 3 generally illustrates a more or less maximum misalignment of guns 36 which occurs when one of orienting fins 42, identified as fin 42A, is positioned substantially vertically. This means that the other orienting fin, identified as 42B, is disposed at an angle $\alpha$ from a vertical center line 120 of casing 22. Except for slight frictional constraints or debris in casing 22, guns 36 will be substantially located at low point 122 on vertical center line 120 at the bottom side of casing 22. This results in perforating charge 116A being disposed at an angle $\beta$ with respect to a horizontal center line 124 of casing 22. A radially extending line 126 from center point 128 of gun 36 through perforating charge 116B will be seen to intersect the outside of casing 22 at point 130. Thus, point 130 is disposed at an angle $\gamma$ with respect to horizontal center line 124 of casing 22.

In an example, wherein angle $\alpha$ is selected to be approximately 45° and in which a standard Vanngun perforating gun is disposed in a 5½-inch casing, $\beta$ equals approximately 22°, and $\gamma$ equals 9½° approximately. Since all of the guns will fall within this outside condition and the nominal position shown in FIG. 2, the distribution of the various perforations 118 will be generally acceptable and will still be oriented mostly downwardly, although some may angle upwardly at 9½°. Of course, perforating charges 116 may be oriented in any preselected position, and the invention is not intended to be limited to those situations in which perforating charges 116 are directed mostly downwardly.

In a perforating operation, time domain firer 34 is actuated to initiate uppermost first gun 38 of the uppermost gun set 36. First gun 38 will then trigger its corresponding second gun 40 which will in turn ignite booster 92 in uppermost bi-directional explosive transfer apparatus 10.

The ignited powder in booster 92 ignites DET cord 96 which in turn ignites charge 102 in DET cord initiator 98. This subsequently ignites shaped charge 104 which is shaped to send a jet toward wall portion 106. This explosive jet is sufficient to burn through the barrier formed by wall portions 106 and 108 and ignite the facing shaped charge 104 in second explosive device 86. The explosive transfer occurs through second explosive device 86 in reverse order from that just described for first explosive device 84. Eventually, firing device 110 in first gun 38 is ignited. This sequence is repeated through the other gun sets 36 and bi-directional explosive transfer apparatus 10, eventually firing lower gun 44, assuming that there is no break in the firing sequence.

There may be occasions when it will be desirable to ignite gun string 30 from the bottom. In this event, time domain firer 46 is fired which initiates the firing of lower gun 44 which in turn ignites second explosive device 86 in the lowermost apparatus 10. The explosive transfer in this case follows an upward path through apparatus 10 to ignite the lowermost gun set 36. This sequence is repeated upwardly until the uppermost gun set 36 is fired. Since apparatus 10 is symmetrical with essentially identical first and second explosive devices 84 and 86 disposed therein and facing one another, it will be seen that apparatus 10 is bi-directional, allowing firing from the top down or from the bottom up.

As described, this bi-directional firing capability allows the operator to select between firing gun string 30 from the top or the bottom. Also, if there is a misfire in one direction, gun string 30 may be then triggered from the other direction to fire the remaining guns, assuming there is not an additional misfire. Thus, the apparatus allows for one misfire situation without the necessity of removing the entire tubing string 12 from casing 22.

It will be seen, therefore, that the bi-directional explosive transfer apparatus of the present invention is well adapted to carry out the ends and advantages mentioned, as well as those inherent therein. While a presently preferred embodiment of the apparatus and a self-orienting gun string utilizing the apparatus have been shown for the purposes of this disclosure, numerous changes in the arrangement and construction of parts may be made by those skilled in the art. All such changes are encompassed within the scope and spirit of the appended claims.

What is claimed is:

1. An apparatus for use in connecting downhole perforating guns, said apparatus comprising:

a housing adapted for attachment to the perforating guns, said housing defining a housing cavity therein;

a first explosive device comprising a shaped charge disposed in a first portion of said housing cavity; and a second explosive device comprising a shaped charge disposed in a second portion of said housing cavity and spaced from said first explosive device;

wherein:

said shaped charge of said first explosive device faces said second explosive device and is adapted for sending an explosive jet toward said second explosive device, thereby providing an explosive transfer from one of said guns to said second explosive device; and said shaped charge of said second explosive device faces said first explosive device and is adapted for sending an explosive jet toward said first explosive device, thereby providing an explosive transfer from another of said guns to said first explosive device.

2. The apparatus of claim 1 wherein:

said housing comprises first and second housing sections; and said first portion of said housing cavity is defined in said first housing section; and said second portion of said housing cavity is defined in said second housing section.

3. The apparatus of claim 2 wherein said first and second portions of said housing cavity are separated by a portion of said housing.

4. The apparatus of claim 3 wherein said portion of said housing comprises:

a wall portion of said first housing section; and a wall portion of said second housing section adjacent to said wall portion of said first housing section.

5. The apparatus of claim 2 wherein said first housing section is pivotally connected to said second housing section.

6. The apparatus of claim 5 wherein:

said first and second housing sections define a bearing raceway therebetween; and further comprising bearing means adjacent to said raceway for providing relative rotation between said housing sections.

7. The apparatus of claim 6 wherein said bearing means is characterized by a plurality of balls disposed in said raceway.

8. The apparatus of claim 1 wherein each of said first and second explosive devices further comprises:

a booster;

a length of detonating cord connected to said booster; and a detonating cord initiator connected to said detonating cord wherein, a corresponding one of said shaped charges is disposed adjacent to said initiator.

9. The apparatus of claim 1 further comprising a barrier disposed between said first and second explosive devices.

10. An apparatus for use in connecting downhole perforating guns, said apparatus comprising:

a housing comprising:

a first housing portion adapted for attachment to one of said perforating guns; and a second housing portion rotatably attached to said first housing portion and adapted for attachment to another of said perforating guns; and explosive means disposed in said first and second housing portions for providing a bi-directional explosive path through said housing, said explosive means comprising:

a first explosive device disposed in said first housing portion and having a shaped charge; and a second explosive device disposed in said second housing portion and having a shaped charge;

wherein, the shaped charges of said first and second explosive devices are directed toward one another such that one of said first and second explosive devices selectively provides an explosive transfer to the other of said first and second explosive devices.

11. The apparatus of claim 10 further comprising bearing means adjacent to said first and second housing portions for allowing relative rotation therebetween.

12. The apparatus of claim 11 wherein said bearing means is characterized by a ball bearing.

13. The apparatus of claim 12 wherein said ball bearing comprises:

a first bearing race defined by one of said first and second housing portions;

a second bearing race defined by the other of said first and second housing portions; and a plurality of balls in rolling contact with said first and second races.

14. The apparatus of claim 13 further comprising retainer means for retaining said balls between said first and second bearing races.

15. The apparatus of claim 10 wherein at least one of said first and second housing portions comprises a barrier between said first and second explosive devices, such that said barrier is destroyed when either of said first and second explosive devices is fired.

16. A well perforating apparatus comprising:

a first perforating gun;

a second perforating gun spaced from said first perforating gun; and a bi-directional explosive transfer device interconnecting said first and second perforating guns, said explosive transfer device comprising:

a pair of shaped charges directed toward one another such that firing of one of said first and second perforating guns will ignite one of said shaped charges, such that an explosive jet is directed from said one of said shaped charges to the other of said shaped charges, thereby igniting said other of said shaped charges and thereby firing the other of said first and second perforating guns.

17. The apparatus of claim 16 wherein said bi-directional explosive transfer device comprises a swivel connection.

18. The apparatus of claim 17 wherein:

said shaped charges are disposed in said swivel connection; and said swivel connection comprises a barrier portion between said shaped charges.

19. The apparatus of claim 17 wherein said swivel connection comprises:

a first portion forming a first bearing race thereon;

a second portion forming a second bearing race thereon generally facing said first bearing race; and a plurality of bearing balls disposed between said first and second bearing races and in rolling contact therewith.

20. The apparatus of claim 17 further comprising an orienting fin disposed on at least one of said perforating guns, said fin being adapted for substantially orienting said one of said perforating guns in a predetermined position with respect to a wellbore.

21. The apparatus of claim 20 further comprising at least two of said fins angularly disposed from one another.

22. The apparatus of claim 20 wherein said fin is disposed generally opposite a firing head of said one of said perforating guns.

23. A method of perforating a well comprising the steps of:

positioning a string of perforating guns in a wellbore, said string comprising at least an upper and a lower perforating gun;

positioning a bi-directional explosive device between adjacent guns, said bi-directional explosive device comprising a pair of shaped charges directed toward one another such that an explosive jet from one of said shaped charges will ignite the other of said shaped charges; and firing one of said upper and lower guns and thereby igniting one of said shaped charges such that said one of said shaped charges ignites the other of said shaped charges and, thereby sequentially firing a remainder of said guns.

24. The method of claim 23 further comprising the step of providing rotation of said guns with respect to one another and thereby positioning a swivel connection between said guns such that said guns are free to rotate and orient themselves by gravity.

* * * * *